US006665890B1

(12) United States Patent
Tedrick

(10) Patent No.: US 6,665,890 B1
(45) Date of Patent: Dec. 23, 2003

(54) SPA COVER LIFTER

(76) Inventor: John Tedrick, 4937 S. 86th E. Ave., Tulsa, OK (US) 74145

( * ) Notice: Subject to any disclaimer, the term of this patent is extended or adjusted under 35 U.S.C. 154(b) by 0 days.

(21) Appl. No.: 10/437,968

(22) Filed: May 15, 2003

(51) Int. Cl.[7] ..... E04H 4/00

(52) U.S. Cl. ..... 4/498; 4/500; 49/255; 220/263

(58) Field of Search ..... 4/498, 500, 580; 220/263, 816; 49/255

(56) References Cited

U.S. PATENT DOCUMENTS

| | | | | | |
|---|---|---|---|---|---|
| 1,028,499 | A | * | 6/1912 | Schott | 220/816 |
| 1,634,029 | A | * | 6/1927 | Korkames | 220/816 |
| 2,955,452 | A | * | 10/1960 | Myers | 49/255 |
| 3,021,530 | A | * | 2/1962 | Sears | 4/500 |
| 3,895,400 | A | * | 7/1975 | Kelcey | 4/500 |
| 4,163,295 | A | * | 8/1979 | Schutz | 4/500 |
| 5,048,153 | A | * | 9/1991 | Wall et al. | 4/498 |
| 5,531,541 | A | * | 7/1996 | Clover et al. | 220/816 |
| 5,819,332 | A | * | 10/1998 | Perry | 4/498 |
| 5,974,600 | A | * | 11/1999 | Pucci et al. | 4/498 |
| 6,032,305 | A | * | 3/2000 | Tedrick | 4/498 |
| 6,550,077 | B1 | * | 4/2003 | Tedrick | 4/500 |

* cited by examiner

*Primary Examiner*—Gregory Huson
*Assistant Examiner*—Khoa Huynh

(57) ABSTRACT

A device for removing spa covers and putting them aside while the spa is in use, and returning them to cover the spa after use. This invention lifts the cover in the flat position, then the cover may be rotated clockwise or counter clockwise to uncover the spa for use.

16 Claims, 5 Drawing Sheets

SPA COVER LIFTER

BACKGROUND OF THE INVENTION

1. Field of the Invention

The invention relates to a lifting mechanism for removing and replacing the cover of a spa. The use of spas has become widespread, and most spas are equipped with covers which when closed prevents debris, rain and the like from contaminating the tub water. The cover further serves to retain heat within the tub. As a consequence, spa covers tend to be relatively heavy and difficult to remove and replace.

Lifting devices have been developed to aid in the removal and replacement of these relatively heavy spa covers which can be operated with varying amounts of difficulty. Some problems exist with past lifting mechanism designs. A unit with one bar can produce excessive wear on the edge of spa and the bottom of the spa cover when the cover is slid and pushed to the "off" position.

With only one lift bar rigidity suffers and spa covers tends to become angularity offset when the operator pulls or pushes on one side only.

Many lifters require the user to fold the cover at the half-way seam. If the wind is blowing at a stiff breeze this can be a difficult struggle for a young athletic person, an impossible task for the elderly or disabled person. However, many spa owners do not have adequate space to rotate a large cover. Thus owners could request a folding cover on a rotating lifter; this choice is illustrated in these embodiments.

2. Description of Related Art

I have found a number of spa cover lifter patents using an "over end" motion. Such as; Wall U.S. Pat. No. 5,048,153A, Oyelette U.S. Pat. No. 5,548,081A, Perry U.S. Pat. No. 5,819,332A, Pucci U.S. Pat. No. 5,974,600A, Tedrick U.S. Pat. No. 6,032,305A, Tedrick U.S. Pat. No. 6,393,630B1, there in on conflict. I do have one patent, U.S. Pat. No. 6,550,077B1, which uses the lift, and rotate method to remove and store the cover. There are three major differences between 077 and this invention. 1. All the lifting is done at the bottom of the push tube instead of under the swash plate. 2. The swash plate, roller and guide tube are not used, new mount bocks are used to hold and guide the push tube. 3. Shelves are not required to hold the various lifting apparatus.

Refer to 077, in all the drawings I show a solid spa cover, a folding cover could be used in those instances where desired. In this invention I have shown folded covers in all drawings. These covers are interchangeable.

DESCRIPTION OF THE INVENTION

This invention is designed to lift a spa cover (42–43) and allow the cover to be rotated to clear the spa tub (44). Means for raising and lowering is accomplished by using one of several power devices, namely a crank and screw (50) and (51), a hydraulic jack (57), a foot ratchet (54), a linear actuator (58) and a cam jack (59). A fabric hinge is shown as (53).

A selected device applies an upward force on push tube (46). Crane arm (44) is attached to the push tube (46). Attachment (45) holds the cover (43) to the crane arm (44). An upper ported mount block (47) and a lower ported mount block (48) maintain alignment for push tube (46) operation. A post (55) may be installed near the spa (41) to provide lifting without attachment to the spa (41). Emplacement (56) keeps post (55) in place.

DESCRIPTION OF THE DRAWINGS

The foregoing objects and many of the attendant advantages of this invention will become more readily apparent as the same becomes better understood by reference to the following drawings. The crane arm with cover attached is common to all drawings.

FIG. (1) is a side view of the spa with mount blocks attached, push tube is aligned thru the blocks, and the crank and screw provides the lifting power.

Figure 1:
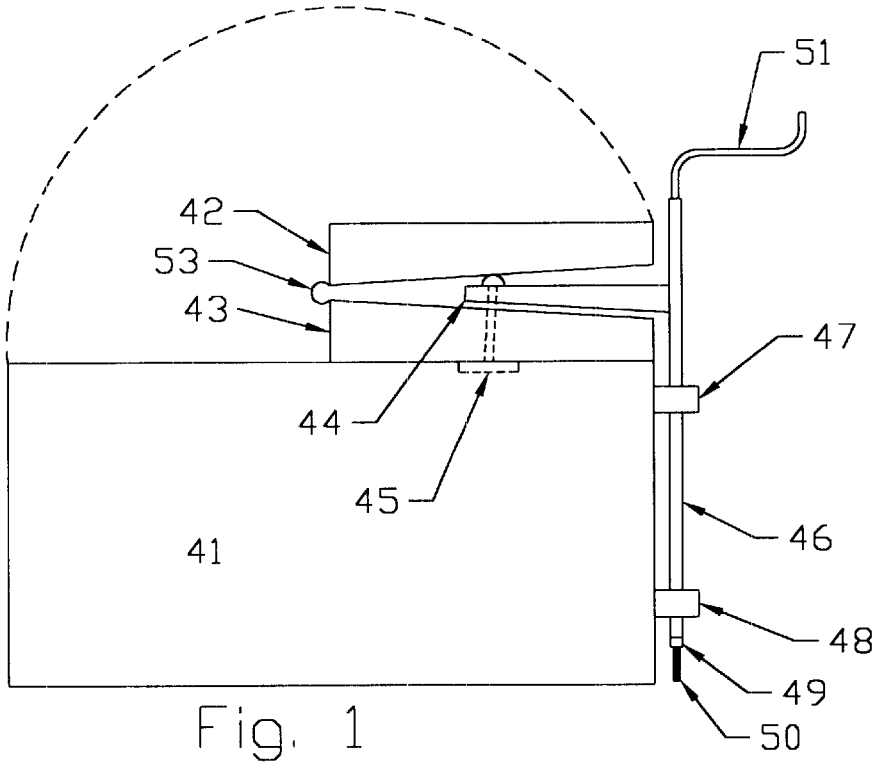
Figure 2:
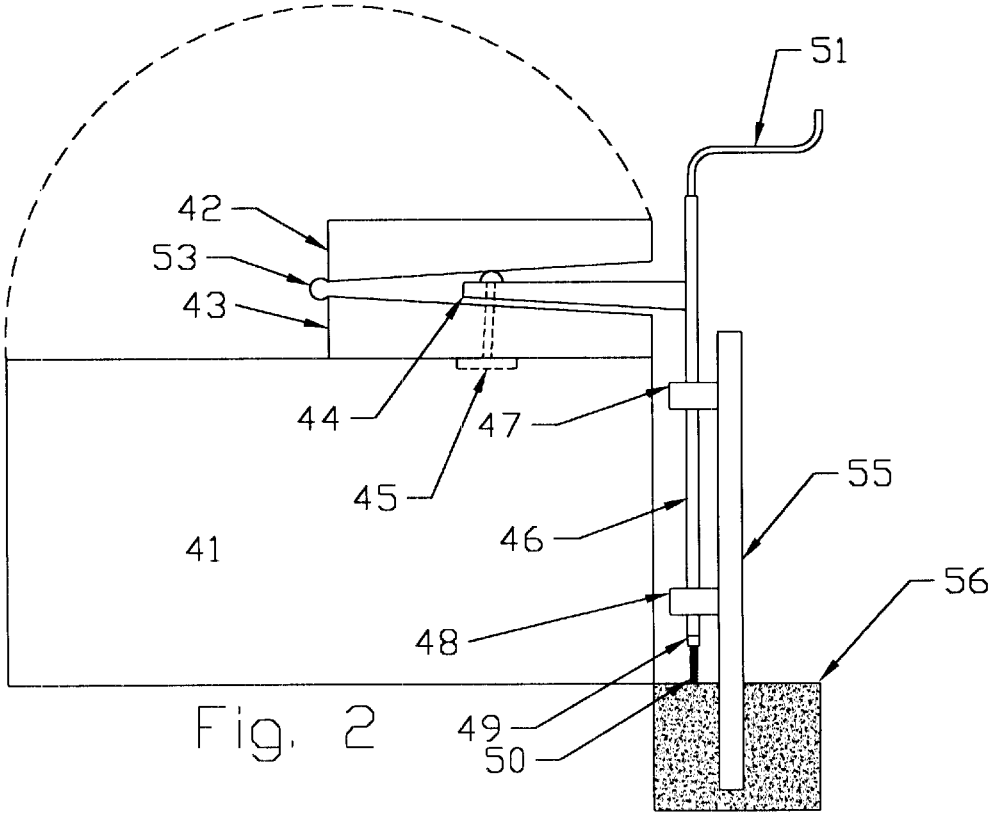
Figure 3:
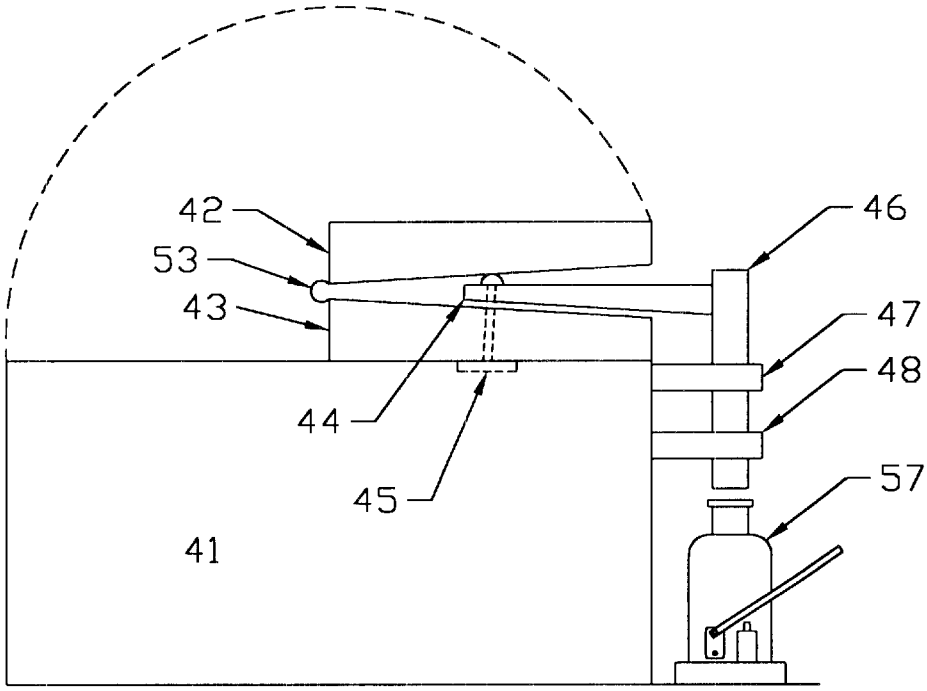
Figure 4:
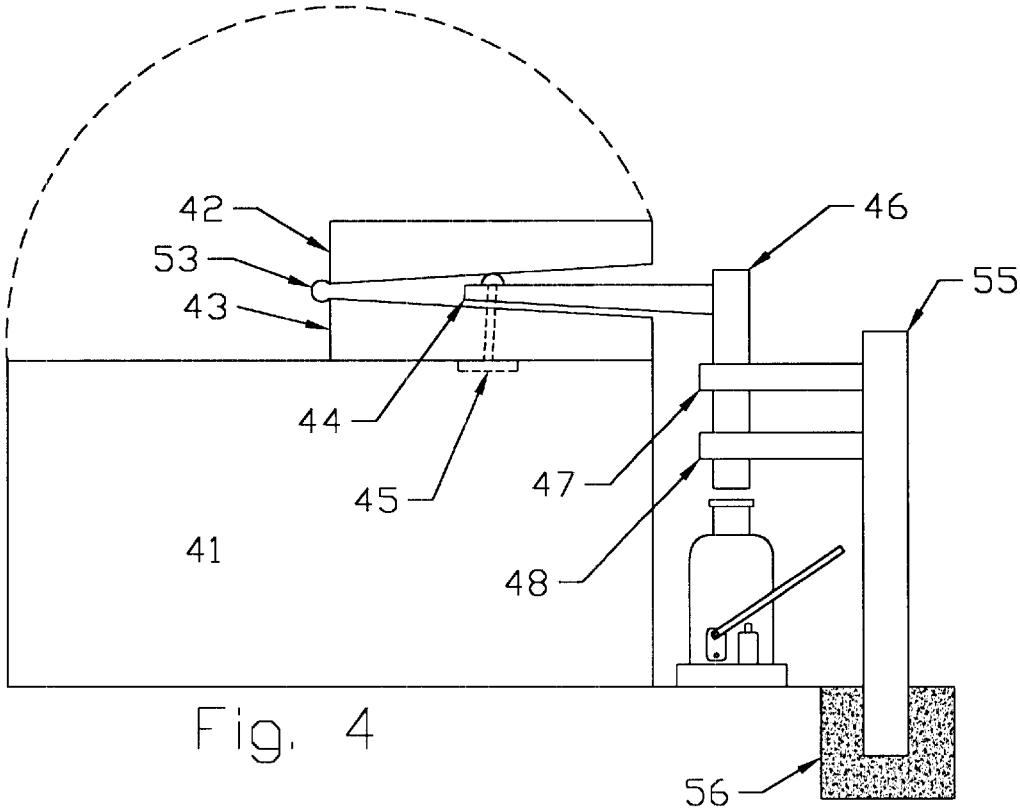
Figure 5:
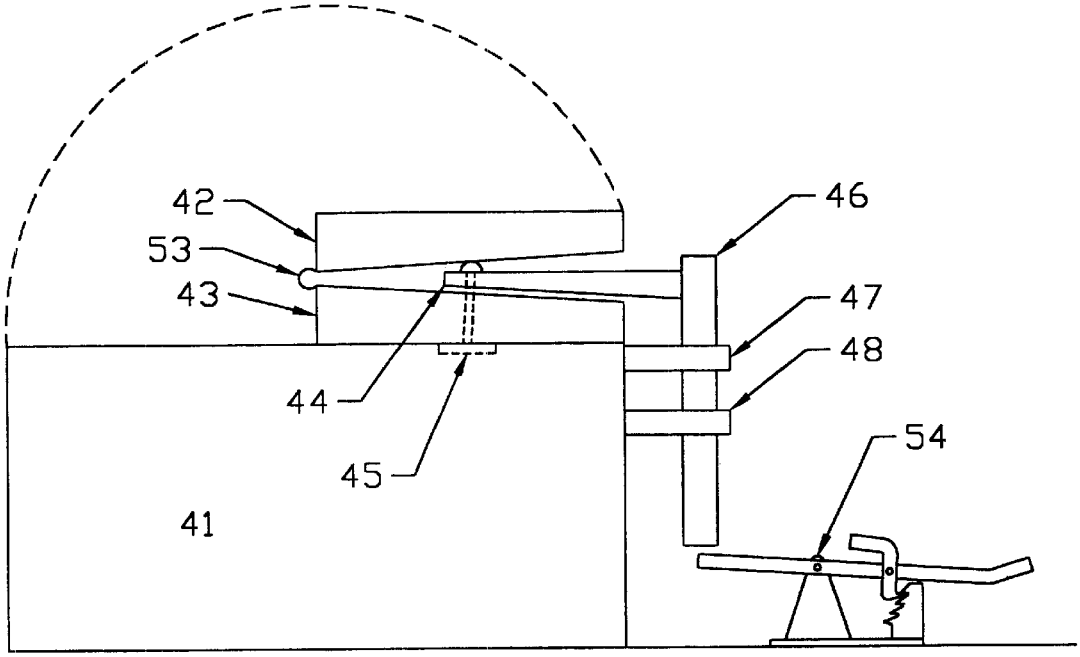
Figure 6:
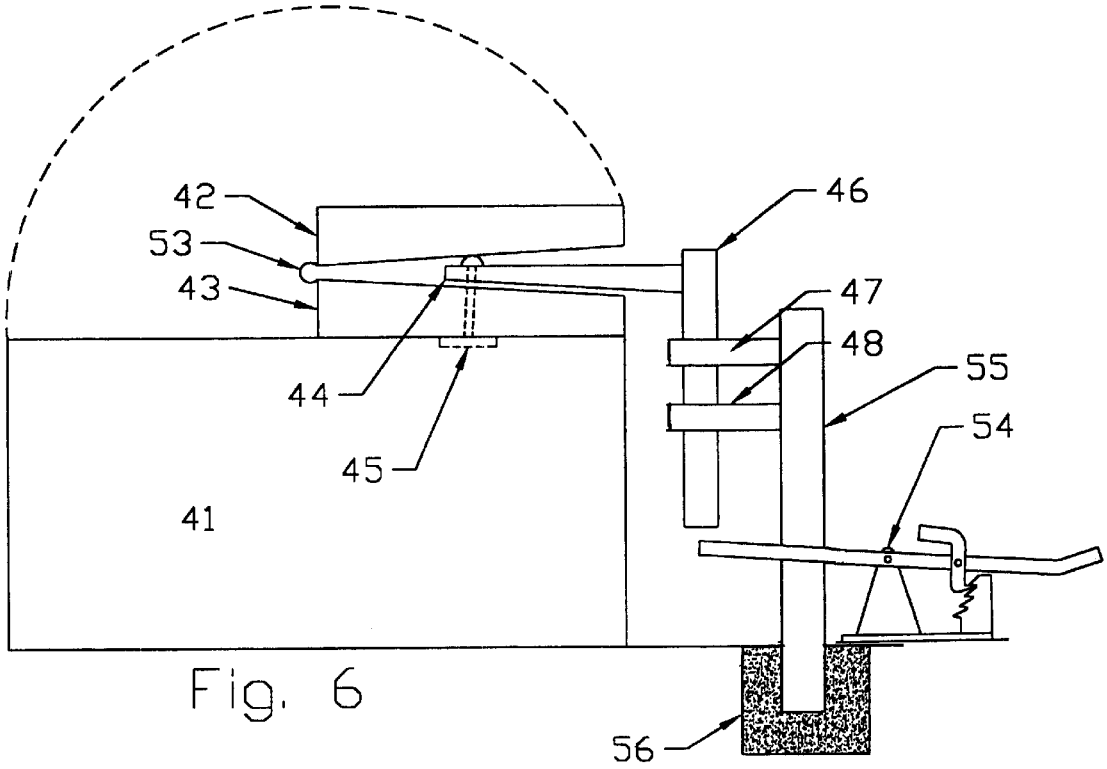
Figure 7:
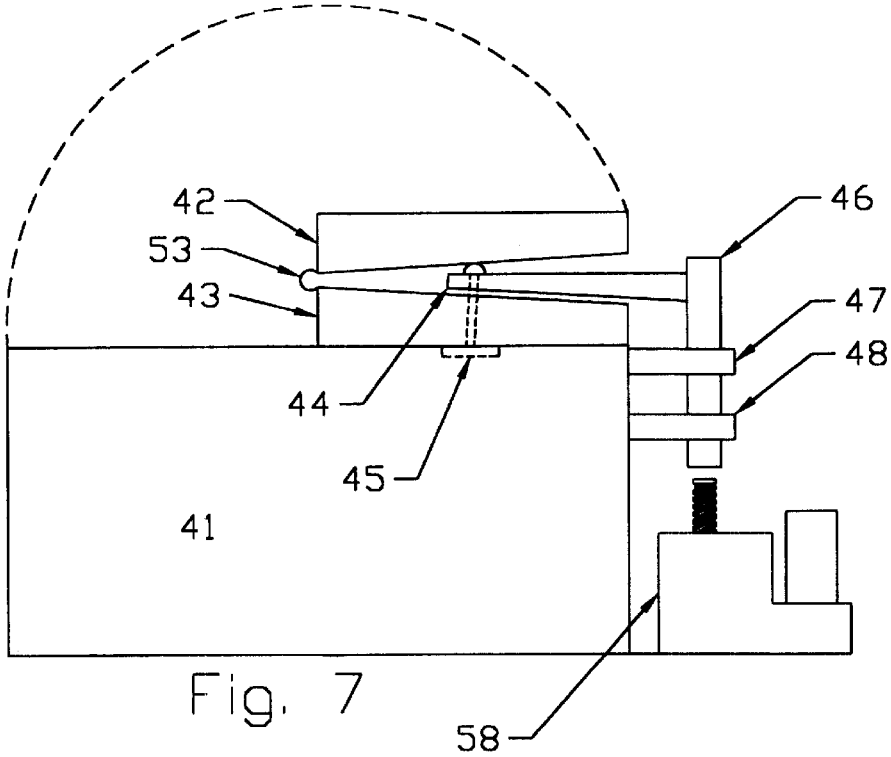
Figure 8:
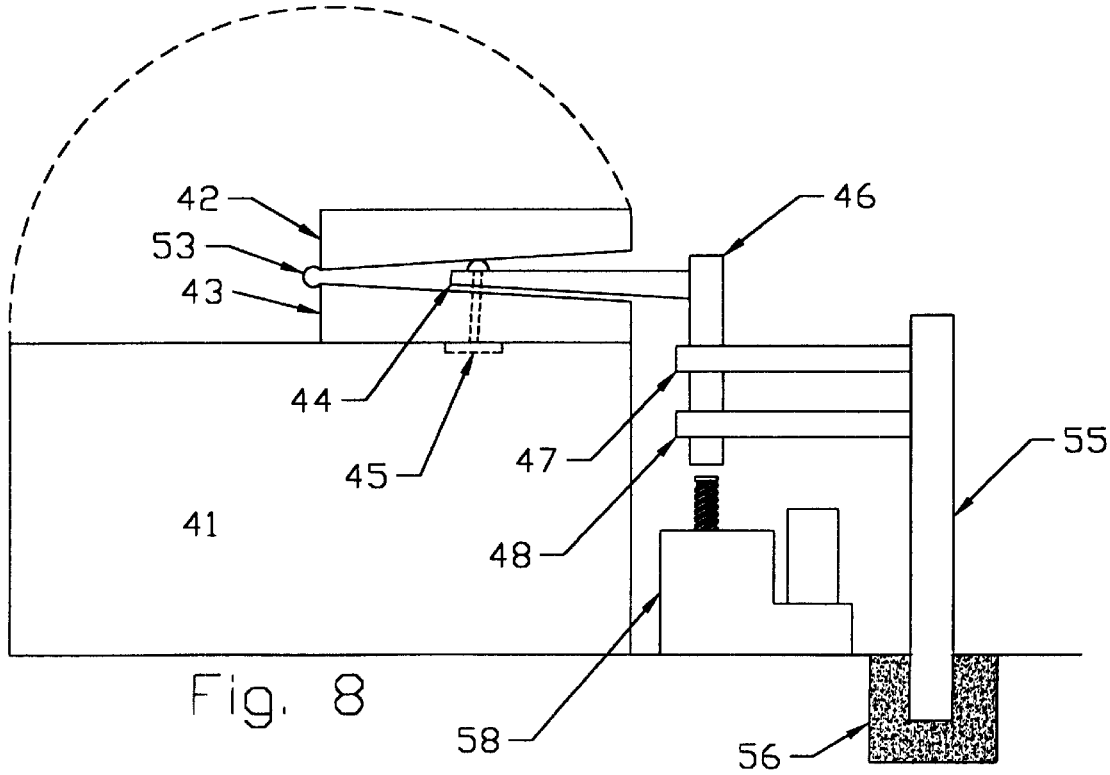
Figure 9:
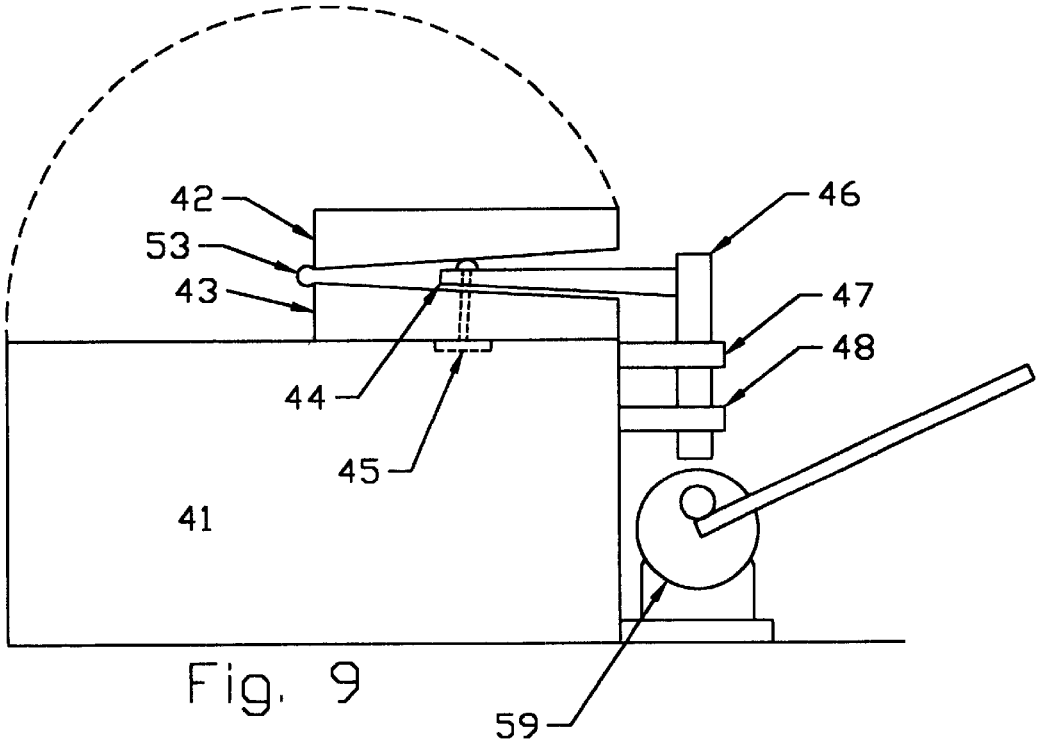
Figure 10:
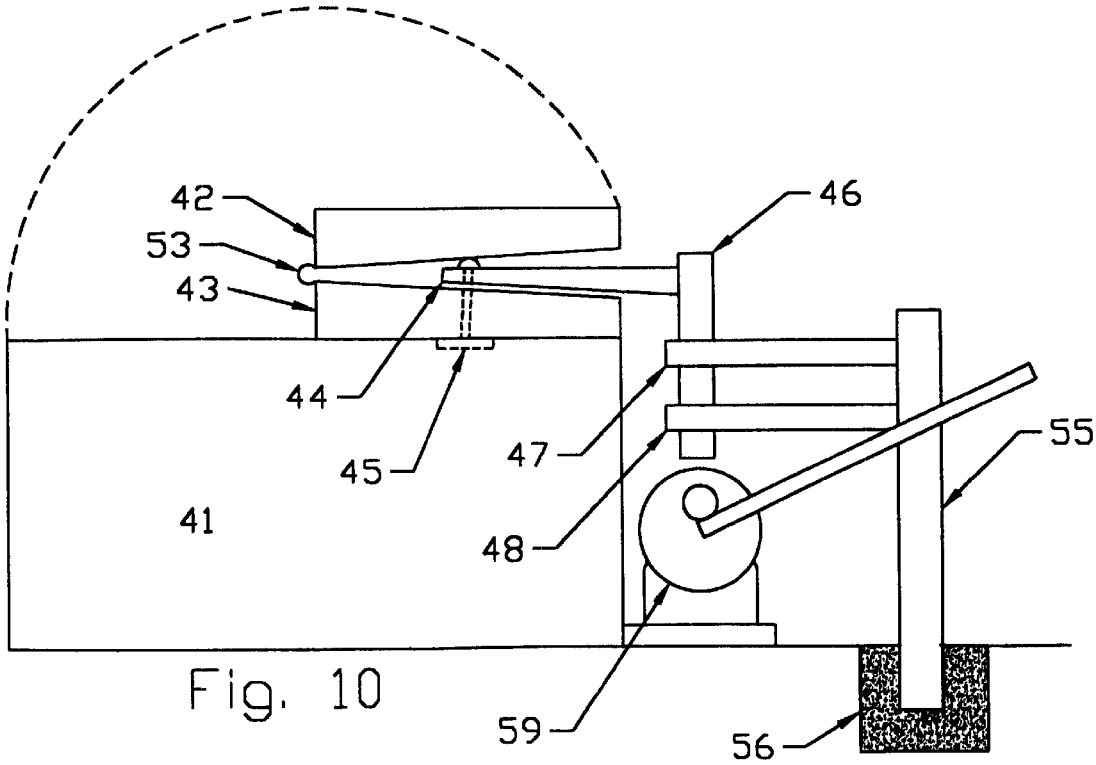

FIG. (2) is a side view of the spa with mount blocks attached to a post near the spa, push tube is aligned thru the blocks, and the crank and screw provides the lifting power. The post is set in its emplacement.

FIG. (3) is a side view of the spa with mount blocks attached, push tube is aligned thru the blocks, and the hydraulic jack provides the lifting power.

FIG. (4) is a side view of the spa with mount blocks attached to a post near the spa, push tube is aligned thru the blocks, and the hydraulic jack provides the lifting power. The post is set in its emplacement.

FIG. (5) is a side view of the spa with mount blocks attached, push tube is aligned thru the blocks, and the foot ratchet provides the lifting power.

FIG. (6) is a side view of the spa with mount blocks attached to a post near the spa, push tube is aligned thru the blocks, and the foot ratchet provides the lifting power. The post is set in its emplacement.

FIG. (7) is a side view of the spa with mount blocks attached, push tube is aligned thru the blocks, and the linear actuator provides the lifting power.

FIG. (8) is a side view of the spa with mount blocks attached to a post near the spa, push tube is aligned thru the blocks, and the linear actuator provides the lifting power. The post is set in its emplacement.

FIG. (9) is a side view of the spa with mount blocks attached, push tube is aligned thru the blocks, and the rotating cam provides the lifting power.

FIG. (10) is a side view of the spa with mount blocks attached to a post near the spa, push tube is aligned thru the blocks, and the rotating cam provides the lifting power. The post is set in its emplacement.

What is claimed is:

1. A spa cover lifter in combination with a spa and a spa cover, said spa cover lifter comprising upper and lower mount blocks having ports, said mount blocks being mounted relative to said spa with said ports vertically aligned over one another, a vertical push tube aligned through said ports and having vertical and rotational movements, a means for raising and lowering said push tube crane arm attached to an upper side of said push tube and attachments connecting the cover to said crane arm, wherein the vertical push tube allows the cover to be lifted in a flat position and rotated to uncover the spa for use.

2. The spa cover lifter according to claim 1, said raising and lowering means comprising a hand crank.

3. The spa cover lifter according to claim 2, said mount blocks being fixed to said spa.

4. The spa cover lifter according to claim 2, said mount blocks being connected proximate said spa.

5. The spa cover lifter according to claim 1, said raising and lowering means comprising a hydraulic jack.

6. The spa cover lifter according to claim 5, said mount blocks being fixed to said spa.

7. The spa cover lifter according to claim 5, said mount blocks being connected proximate said spa.

8. The spa cover lifter according to claim 1, said raising and lowering means comprising a foot pedal.

9. The spa cover lifter according to claim 8, said mount blocks being fixed to said spa.

10. The spa cover lifter according to claim 8, said mount blocks being connected proximate said spa.

11. The spa cover lifter according to claim 1, said raising and lowering means comprising an electric motor.

12. The spa cover lifter according to claim 11, said mount blocks being fixed to said spa.

13. The spa cover lifter according to claim 11, said mount blocks being connected proximate said spa.

14. The spa cover lifter according to claim 1, said raising and lowering means comprising a cam.

15. The spa cover lifter according to claim 14, said mount blocks being fixed to said spa.

16. The spa cover lifter according to claim 14, said mount blocks being connected proximate said spa.

* * * * *